US006474831B1

(12) United States Patent
Ruuttu et al.

(10) Patent No.: US 6,474,831 B1
(45) Date of Patent: Nov. 5, 2002

(54) LIGHT FITTING

(76) Inventors: Jari Ruuttu, Ruukintie 4, FIN-10330 Billnäs (FI); Filip Törnroos, Sirkkalankatu 24 C 15-17, FIN-20700 Turku (FI)

( * ) Notice: Subject to any disclaimer, the term of this patent is extended or adjusted under 35 U.S.C. 154(b) by 0 days.

(21) Appl. No.: 09/720,740

(22) PCT Filed: Jul. 2, 1999

(86) PCT No.: PCT/FI99/00591

§ 371 (c)(1),
(2), (4) Date: Feb. 27, 2001

(87) PCT Pub. No.: WO00/01985

PCT Pub. Date: Jan. 13, 2000

(30) Foreign Application Priority Data

Jul. 2, 1998 (FI) ..... 981530

(51) Int. Cl.[7] ..... F21S 8/02; F21V 17/18

(52) U.S. Cl. ..... 362/148; 362/307; 362/310; 362/341; 362/364; 362/376; 362/437

(58) Field of Search ..... 362/148, 150, 362/296, 307, 310, 341, 376, 433, 437, 439, 451, 453, 454, 147, 364–366, 308, 329

(56) References Cited

U.S. PATENT DOCUMENTS

| | | | | | |
|---|---|---|---|---|---|
| 1,457,058 | A | * | 5/1923 | Fitchet | 362/437 |
| 1,548,252 | A | * | 8/1925 | Breuss | 362/310 |
| 1,741,693 | A | * | 12/1929 | Gillinder | 362/433 |
| 1,743,847 | A | * | 1/1930 | Doane | 362/433 |
| 1,852,432 | A | | 4/1932 | D'Olier, Jr. | 362/343 |
| 4,628,423 | A | * | 12/1986 | Ogle | 362/341 |
| 5,535,110 | A | * | 7/1996 | Ling | 392/148 |
| 6,132,069 | A | * | 10/2000 | Sato et al. | 362/148 |

FOREIGN PATENT DOCUMENTS

| | | |
|---|---|---|
| DE | 4435207 | 4/1995 |
| EP | 354961 | 2/1990 |
| EP | 499044 | 1/1992 |
| WO | 9104442 | 4/1991 |

* cited by examiner

*Primary Examiner*—Alan Cariaso
(74) *Attorney, Agent, or Firm*—Burns, Doane, Swecker & Mathis

(57) ABSTRACT

A light fitting intended to be fitted on a false ceiling board and comprising a socket part (1), to which a light sources (2) is fastended, and a reflector (3), which directs beams from the light source to the desired object. The reflector center comprises a domed projection (4) for the light source, the reflector (3) and the socket part (1) forming a closed space, in which the light source (2) is located.

5 Claims, 3 Drawing Sheets

LIGHT FITTING

This invention relates to a light fitting intended to be mounted on a false ceiling board and comprising a socket part, to which a light source has been fixed, and a reflector, which directs beams from the light source to the desired object.

All conventional light fittings of this type have the drawback of the light source, i.e. the burner, being constantly visible, and then the light fitting proper is neither dustproof nor waterproof. The burner has to be removed when the reflector is cleaned. If the cleaning is carried out with a moist cloth, the person performing the cleaning may be at the risk of an electric shock. The purpose of this invention is to overcome the drawbacks mentioned above. The light fitting in accordance with the invention is characterised by the fact that the reflector centre comprises a domed projection for the light source, so that the reflector and the socket part form a closed space, in which the light source is located. Owing to the invention, the light source, such as a discharge lamp, a fluorescent tube or any similar discharge lamp sits in a protected space, and then the cleaning of the reflector can be performed even with a moist cloth although the light is switched on. By means of the invention, a discharge lamp will be covered by the mirror surface at the end of the domed projection, and then the discharge lamp will be invisible and its straight, downwards oriented beams will not direct reflexes straight into the person's eyes. The reflector being fixed by means of quick-release lugs so as to allow the reflector to be detached and fastened with a small rotational movement, the burner is readily and rapidly replaced whenever necessary. At the same time, the reflector can be cleaned and even washed with water. In restaurants, for instance, or on similar premises, where there may be cigarette smoke, industrial dust or the like, the light fittings require cleaning at regular intervals. The actual reflector and the domed projection for the light source may be made of one single transparent plastic piece, which is equipped with the necessary mirror surfaces, i.e. reflecting surfaces. The reflector may also be made of two pieces, the domed projection comprising transparent plastic and the actual reflector comprising e.g. a mirror-like metal. Some premises require light fittings that are classified according to specific safety categories. Owing explicitly to the invention, the light fitting in accordance with the invention is suitable for safety category IP44, for instance.

Various embodiments of the invention are defined in the dependent claims of the set of claims.

Figure 1:
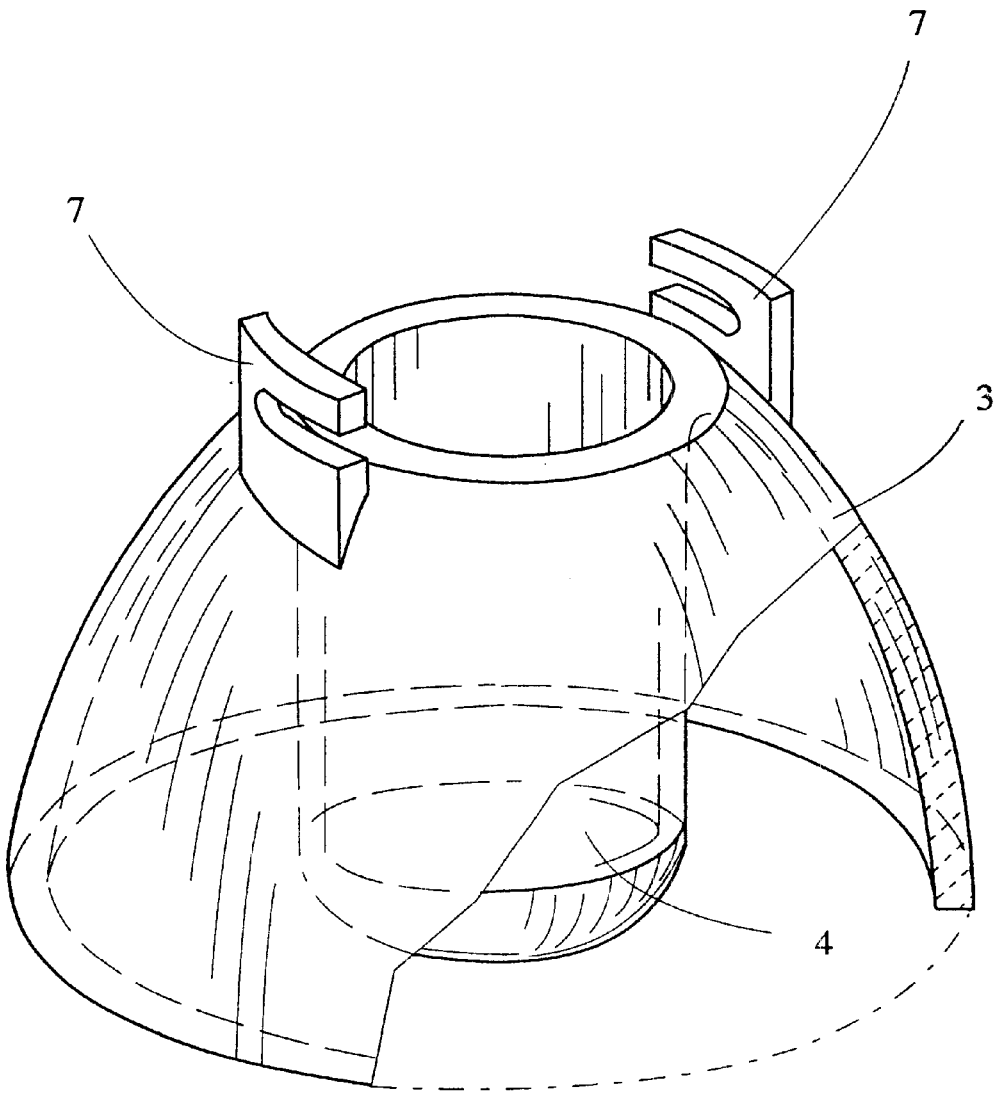
Figure 2:
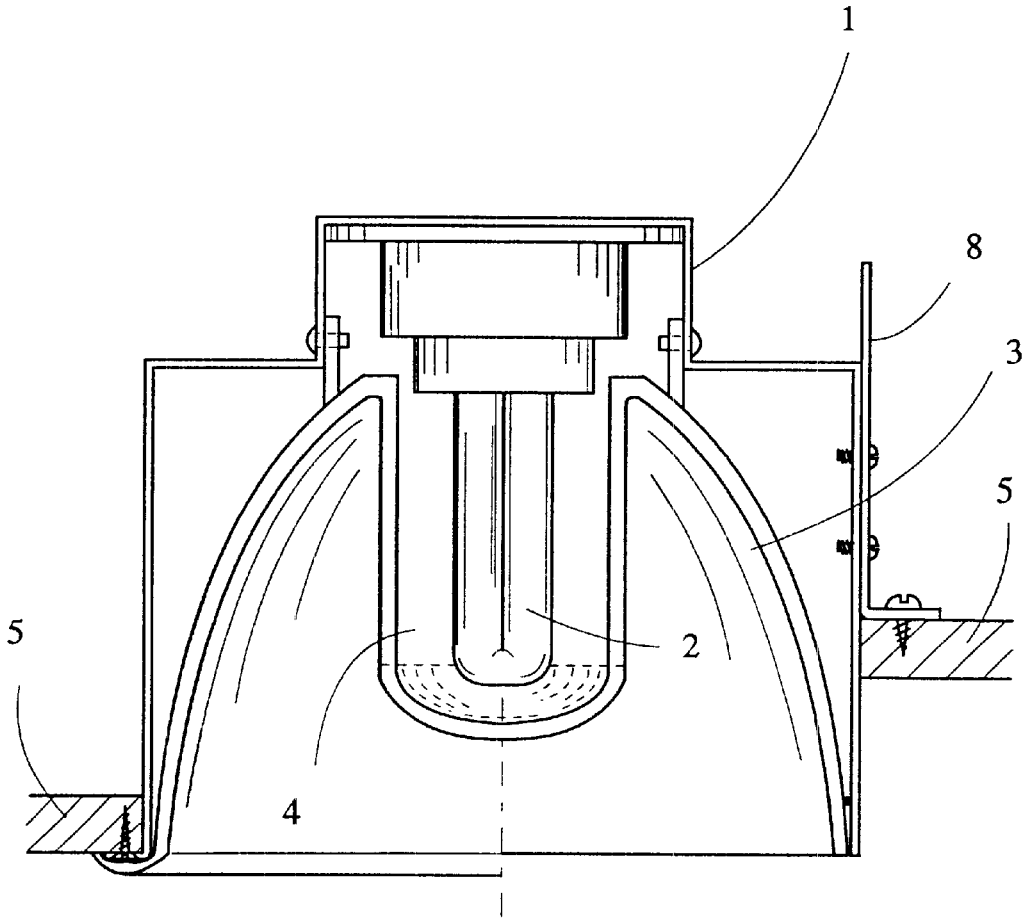
Figure 3:
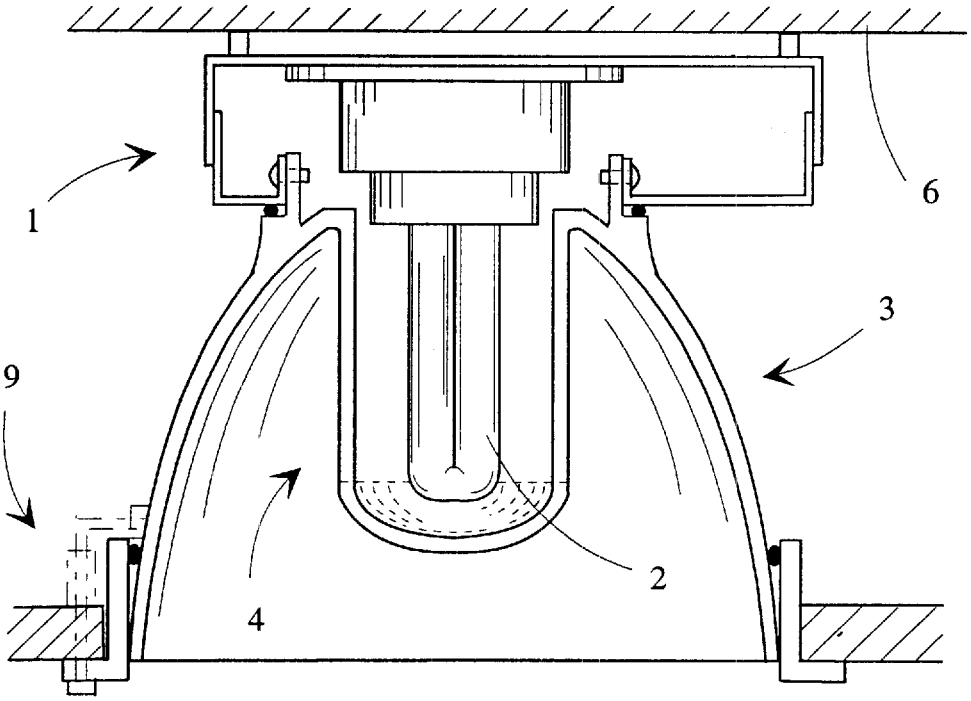

The invention is described below with the aid of an example and with references to the accompanying drawings, of which FIG. 1 is an axionometric view of the reflector in partial section, FIG. 2 shows one embodiment of the light fitting fixed to a false ceiling board, and FIG. 3 shows a second embodiment of the light fitting, in which the light fitting is fixed to the ceiling structure proper.

The light fitting comprises a socket part 1, to which the light source 2 is fixed, and a reflector 3, which directs beams from the light source 2 to the desired object. The centre of the reflector 3 comprises a domed projection 4 for the light source 2, the reflector 3 and the socket part 1 forming a closed space, in which the light source 2 is located.

In FIG. 2, the socket part 1 comprises a housing fixed to the ceiling board 5, such as a cylindrical box surrounding the reflector and tightly connected to the reflector.

In FIG. 3, the socket part comprises a housing 1 fixed to the ceiling 6 proper and tightly connected to the reflector 3. The reflector 3 comprises fast-release lugs 7, allowing the reflector to be detached and fastened with a slight rotational movement. That projection 4 provided in the centre of the reflector can be firmly gripped with one hand, and the reflector can be cleaned or the burner replaced without any problems. FIG. 2 also shows an optional system for vertical adjustment, comprising a vertical adjustment lug 8 provided between the housing 1 and the false ceiling board. FIG. 3 illustrated a locking mechanism 9 preventing rotation of the reflector, drawn with a line of dots and dashes. An optional accessory of this type may be necessary for instance in ships, where resonance frequencies occur.

What is claimed is:

1. A light fitting intended to be fitted on a false ceiling board, the light fitting comprising:

a socket part to which the light source is fixed; and a reflector which directs beams from the light source to a desired object, wherein a center of the reflector comprises a domed projection for the light source so that the reflector and the socket part form a closed space in which the light source is located, wherein the reflector comprises fast release lugs so as to allow the reflector to be detached and fastened with a slight rotational movement, and wherein the socket part comprises a housing intended to be fixed to the false ceiling board enclosing the reflector and tightly connected to the reflector.

2. A light fitting as in claim 1, wherein the reflector and the projection are made of one piece.

3. A light fitting as claimed in claim 1, comprising: vertical adjustment lugs for placement between the housing and the false ceiling board.

4. A light fitting for a light source intended to be fitted on a false ceiling board, the light fitting comprising:

a socket part to which the light source is fixed;

a reflector which directs beams from the light source to a desired object, wherein a center of the reflector comprises a domed projection for the light source so that the reflector and the socket part form a closed space in which the light source is located, wherein the reflector comprises fast release lugs so as to allow the reflector to be detached and fastened with a slight rotational movement, wherein the socket part comprises a housing intended to be fixed to the false ceiling board enclosing the reflector and tightly connected to the reflector; and a locking mechanism which locks the reflector to the false ceiling by preventing rotational movement of the reflector.

5. A light fitting intended to be fitted on a false ceiling board, the light source comprising:

a socket part to which the light source if fixed; and a reflector which directs beams from the light source to a desired object, wherein a center of the reflector comprises a domed projection for the light source so that the reflector and the socket part form a closed space in which the light source is located, wherein the reflector comprises fast release lugs so as to allow the reflector to be detached and fastened with a slight rotational movement, wherein the socket part comprise a housing intended to be fixed to the false ceiling board, the housing comprising a cylindrical box enclosing the reflector and tightly connected to the reflector.

* * * * *